United States Patent [19]

Davis

[11] Patent Number: 4,536,833

[45] Date of Patent: Aug. 20, 1985

[54] LIGHTING FIXTURE UTILIZING A MULTI-LAYERED HOLOGRAM AS A LENS ELEMENT

[75] Inventor: Charles S. Davis, New York, N.Y.

[73] Assignee: Knoll International, Inc., New York, N.Y.

[21] Appl. No.: 600,469

[22] Filed: Apr. 16, 1984

[51] Int. Cl.[3] ..... F21V 9/00

[52] U.S. Cl. ..... 362/293; 362/260; 362/308; 362/311; 362/317; 362/330; 362/331

[58] Field of Search ..... 362/293, 307, 308, 311, 362/260, 330, 331, 326, 317

[56] References Cited

U.S. PATENT DOCUMENTS 3,912,921 10/1975 Howe et al. ..... 362/308

4,432,044 2/1984 Lautzenheiser ..... 362/307

*Primary Examiner*—Andrew M. Dolinar

*Attorney, Agent, or Firm*—Robert Scobey

[57] ABSTRACT

A lighting fixture utilizing a spatially fixed light source and a multi-layered hologram as a lens element. The hologram receives light from the source and directs it to a task area. The layers of the lens element are responsive to light of one or more wavelengths of interest and varying angles of incident radiation so as to diffract light from the source toward the task area.

3 Claims, 3 Drawing Figures

LIGHTING FIXTURE UTILIZING A MULTI-LAYERED HOLOGRAM AS A LENS ELEMENT

BACKGROUND OF THE INVENTION

State of the art lighting design emphasizes the importance of directing light to a task area while protecting the user from glare. (Glare is defined as placement of the light source in the direct line of sight of the user.) In the design of a free-standing desk light, forward throw of light is especially important, because placement of the light source should not impose on the user's workspace.

The most effective means for optimizing forward throw is to place the aperture of the lamphead facing the task area. The drawback of this technique is that it places the light source in the line of sight of the user.

An alternative approach is to fix the orientation of the lamphead so that the aperture is always parallel to the work surface and facing down protecting the user from direct glare. Although this is an effective means of eliminating glare, currently available lens/reflector designs do not permit efficient forward throw of the light. Thus the user, in order to receive the light on the task area, must move the desk light uncomfortably close to that area.

BRIEF DESCRIPTION OF THE INVENTION

The use of a specially designed multi-layered holographic lens allows optimizing forward throw of the light from a lamphead while protecting the user from direct glare.

The holographic lens functions as a high cut-off louver with infinitely small cells and no loss in attenuation. This permits the lamphead to be placed with its aperture facing the task area, maximizing forward throw, while protecting the user from glare. The lens is designed to redirect light that would otherwise be in the offending zone, to the task area. Such a lens permits improved fixture efficiency, enhanced forward throw of light and better control of glare than products currently on the market.

In the present invention, the layers of a multi-layered lens are designed to redirect incident light at angles above an offending threshold angle into the task zone. (The offending threshold angle is defined as that angle above which the emitted light is direct glare and below which the light reaches the task area.) The angular displacement of each layer is determined by correlating photometric data obtained from testing a given lamp/reflector combination to the physical parameters of the desk light, i.e., height above work surface and desired distance from task area. Since the redirection of light is also wavelength dependent, the spectral characteristics of the light source are accounted for in designing the layers of the lens so that the spectral components of interest are appropriately directed toward the task area.

The following patents and publications are representative of prior work in holography:

| U.S. Pat. No. | Inventor(s) | Issue Date |
|---|---|---|
| 3,578,838 | James N. Hallock | 05/18/71 |
| 3,619,021 | Klaus Bledermann | 11/09/71 |
| 3,695,744 | Burton R. Clay | 10/03/72 |
| 3,708,217 | Donald H. McMahon | 01/02/73 |

-continued

| U.S. Pat. No. | Inventor(s) | Issue Date |
|---|---|---|
| 3,909,111 | Dietrich Meyerhofer | 09/30/75 |
| 3,957,353 | James R. Fienup et al | 05/18/76 |
| 3,970,358 | Adam Kozma | 07/20/76 |
| 4,245,882 | Byung J. Chang | 01/20/81 |

IBM Technical Disclosure—August 1967, Formation of Optical Elements by Holography, G. T. Sincerbox, Vol. 10 No. 3-August, 1967.

Holography Creates New Breed of Optical Components, Herb Brody—From: High Technology, July/August Vol. 2, No. 4.

While there are various disclosures of multi-layered holograms, there is no suggestion of a multi-layered holographic lens element in a task lighting fixture.

The invention will be better understood by reference to the following detailed description.

DETAILED DESCRIPTION

Figure 1:
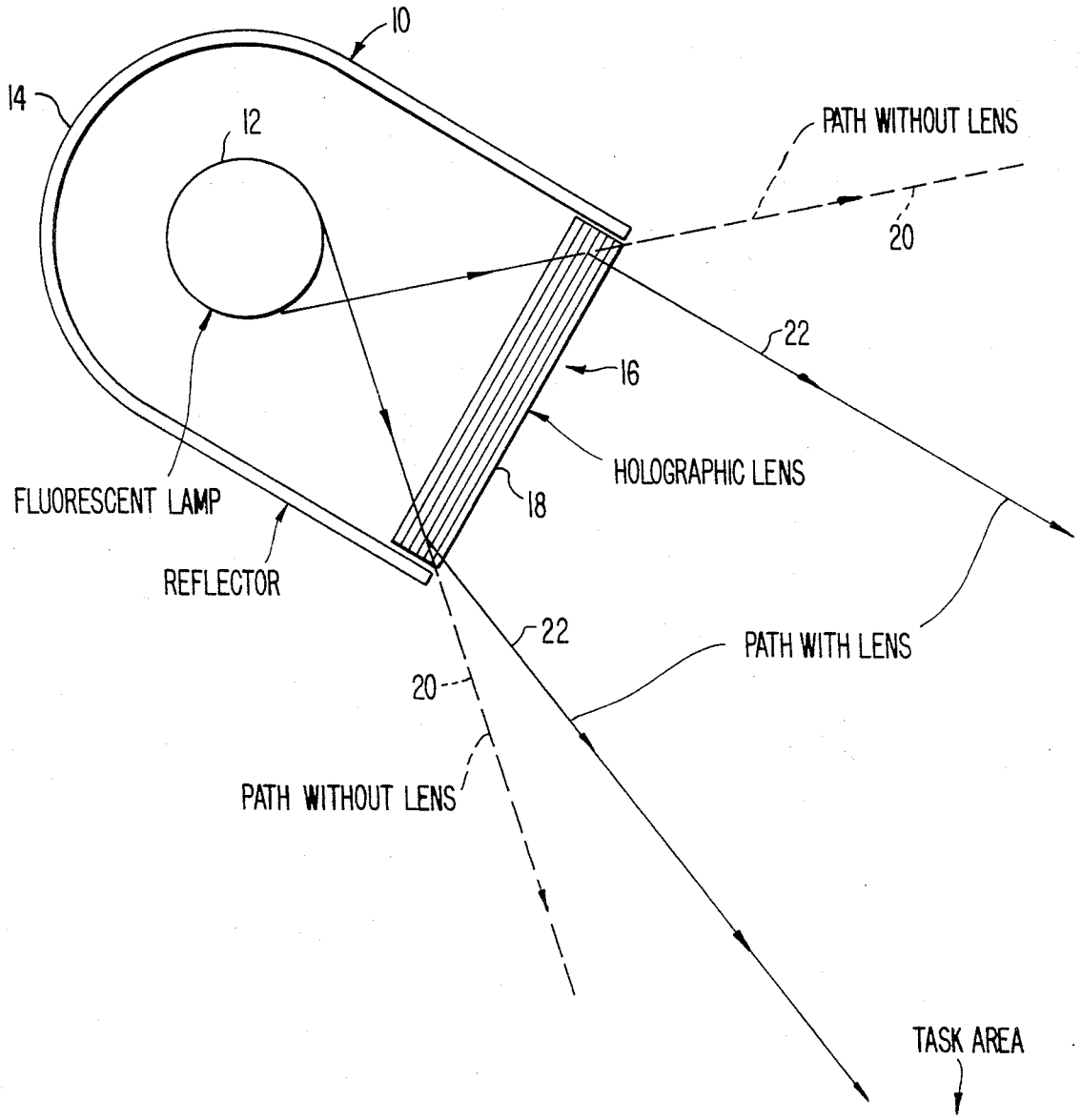
FIG. 1 depicts a lighting fixture embodying the invention.

Referring to FIG. 1, a lighting fixture 10 is shown constituting a presently preferred embodiment of the present invention. The lighting fixture includes a light source 12, which is preferably a conventional fluorescent lamp. That lamp is mounted within a reflective housing 14 in conventional fashion. The housing 14 has a light exit 16 therefrom, across which a holographic lens element 18 is mounted. The function of the holographic lens element is to direct light to a task area, as indicated in FIG. 1. In particular, the holographic lens element is multi-layered, and the layers of the lens element are responsive to light of one or more wavelengths of interest and varying angles of incident radiation to diffract light from the lamp 12 toward the task area. In FIG. 1, dashed lines 20 represent light rays from the lamp 12 which would normally be directed outwardly from the fixture 10 in the absence of the holographic lens, i.e., in directions other than toward the task area. Solid lines 22 represent rays of light as diffracted by the holographic lens element 18, redirected toward the task area.

Figure 2:
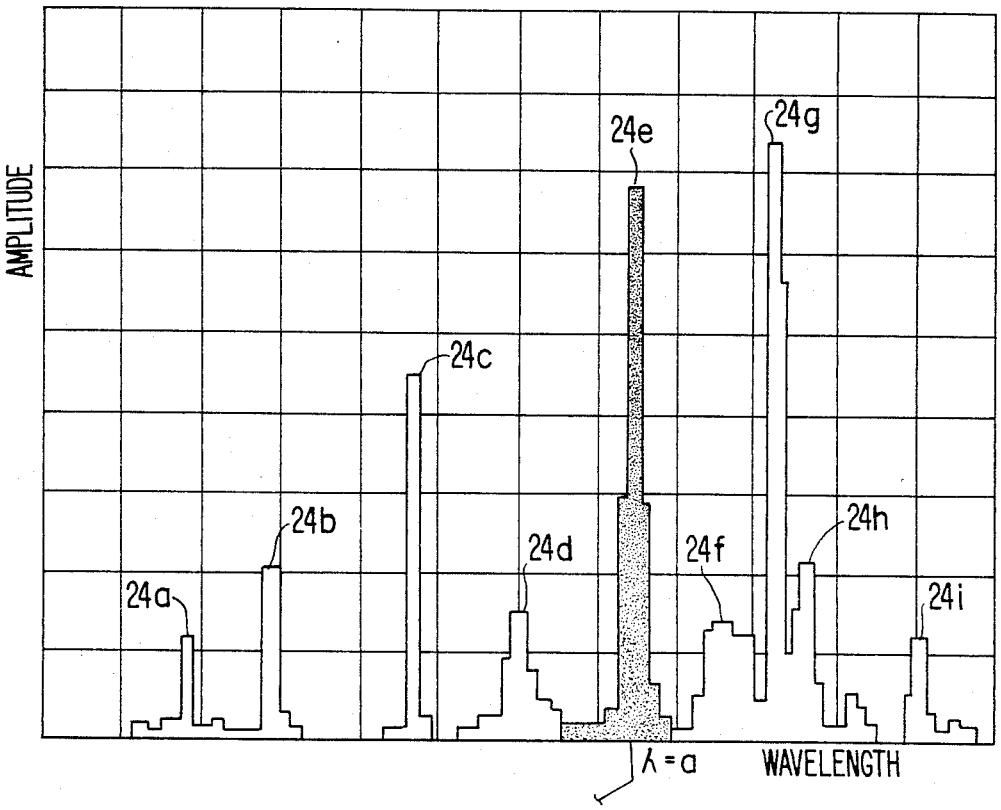
FIG. 2 is a plot of amplitude versus wavelength showing the spectral distribution of the light from the lighting fixture of FIG. 1.
Figure 3:
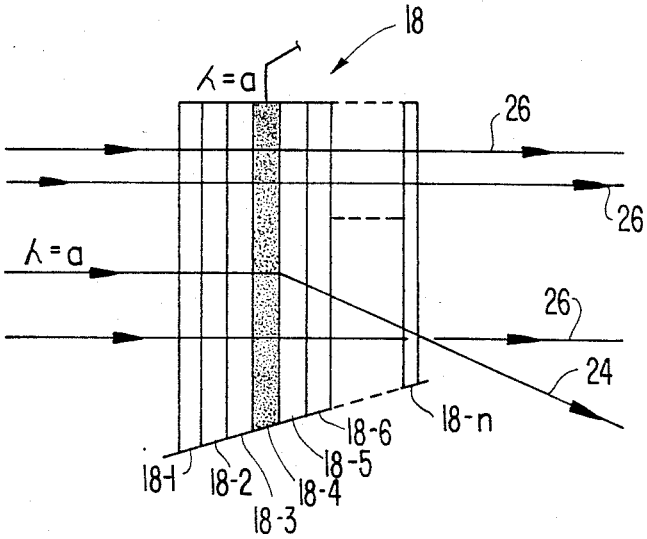
FIG. 3 is an enlarged sectional view of the holographic lens element in the lighting fixture of FIG. 1, showing the diffraction of light by the lens element.

Referring to FIGS. 2 and 3 together, the operation of the holographic lens 18 will be more readily understood. FIG. 2 plots amplitude versus wavelength for the spectral components of the light generated by the fluorescent lamp 12. FIG. 2 is representative of a conventional fluorescent lamp. In the example chosen, the major spectral components have been designated 24*a* to 24*i*, with the spectral components 24*c*, 24*e*, and 24*g* clearly constituting the most predominant components within the wavelength range shown in FIG. 2.

In FIG. 3, the holographic lens element 18 is shown. It is formed of individual layers 18-1, 18-2, 18-3, 18-4, 18-5, 18-6 . . . 18-n. Each layer is responsive to light of a particular wavelength and angle of incidence, acting to diffract light of that wavelength and angle of incidence and to transmit, unidiffracted, light of other wavelengths and angles of incidence. The lens element 18 is constructed of sufficient layers so that, for each spectral wavelength band of interest, light within a desired range of incidence angles is diffracted so as to be directed toward the task area. The individual layers may be fabricated, e.g., by the procedures outlined in *Sincerbox,* supra. Briefly, a reference beam of a given wavelength and incidence angle is directed at an individual photographic emulsion layer, which also receives light from the task area. The light interference is recorded photographically and permanently in the emulsion layer. This is done for all layers to encompass the wavelengths and angles of incidence of interest.

Thus, referring to FIG. 3, if the lens layer 18-4 is responsive to the light of the spectral wavelength $\lambda = a$ and incident at 90°, it will diffract such light as indicated by ray 24. The other rays 26 are undiffracted except when they encounter a lens layer responsive to their wavelength and angle of incidence, to result in appropriate diffraction. In this fashion, all light in spectral bands and angles of incidence of interest may be diffracted to be directed to a task area of interest.

There has been described a presently preferred embodiment of my invention. The invention, however, should be taken to be defined by the following claims.

What I claim is:

1. A lighting fixture comprising a spatially fixed light source, and a multi-layered holographic lens element receiving light from said source and directing said light to a task area, the layers of said lens element being responsive to light of one or more wavelengths of interest and varying angles of incident radiation to diffract light from said source toward said task area.

2. A lighting fixture according to claim 1, including a reflective housing mounting said light source therewithin and having a light exit therefrom, and said lens element being mounted across said light exit.

3. A lighting fixture according to claim 2, in which said light source comprises a fluorescent lamp.

* * * * *